United States Patent [19]

Widell et al.

[11] Patent Number: 4,968,262

[45] Date of Patent: Nov. 6, 1990

[54] CONNECTION DEVICE

[76] Inventors: Harald Widell, Kalendervägen 25; Jan Widell, Augustivägen 11; Nils-Åke Bergman, Junivägen 24, all of S-352 47 Växjö, Sweden

[21] Appl. No.: 375,014

[22] PCT Filed: Dec. 2, 1987

[86] PCT No.: PCT/SE87/00572

§ 371 Date: Jun. 7, 1989

§ 102(e) Date: Jun. 7, 1989

[87] PCT Pub. No.: WO88/04485

PCT Pub. Date: Jun. 16, 1988

[30] Foreign Application Priority Data

Dec. 8, 1986 [SE] Sweden ..... 8605247

[51] Int. Cl.[5] ..... H01R 25/12

[52] U.S. Cl. ..... 439/121

[58] Field of Search ..... 439/118, 119, 121, 122

[56] References Cited

U.S. PATENT DOCUMENTS

| | | | |
|---|---|---|---|
| 3,686,614 | 8/1972 | Hyrylainen | 439/122 |
| 3,718,886 | 2/1973 | Hoffmeister | 439/122 |
| 3,973,818 | 8/1976 | Soquenne . | |
| 3,993,385 | 11/1976 | Seger | 439/122 |
| 4,494,808 | 1/1985 | Widell et al. | 439/119 |

FOREIGN PATENT DOCUMENTS

| | | |
|---|---|---|
| 0007757 | 2/1980 | European Pat. Off. . |
| 0159556 | 10/1985 | European Pat. Off. . |
| 3025913 | 2/1982 | Fed. Rep. of Germany . |
| 413572 | 6/1980 | Sweden . |
| 441557 | 10/1985 | Sweden . |
| 5653181 | 12/1985 | Switzerland . |
| 8701524 | 3/1987 | World Int. Prop. O. . |

*Primary Examiner*—Eugene F. Desmond

*Attorney, Agent, or Firm*—Davis, Bujold and Streck

[57] ABSTRACT

A connection device (10) comprising a body (12, 14), which has at least one outlet hole (30), one insertion part (16) as well as a rotatable and axially displaceable contact and locking bar (18) and is designed to be placed in a substantially C-shaped current rail having a logitudinal hole. The contact and locking bar has three phase conductor pins and a neutral conductor pin designed to cooperate with phase and neutral conductors disposed beside the longitudinal hole of the current rail. The contact and locking bar (18) is pivoted and axially displaced by means of an operating arm (38) provided with an eccentric. The operating arm is retained in a pulled down fastened position by means of a sliding lid (32), which cooperates with a built-in switch (34) of the connection device. The connection device includes a phase selector device (100), disposed in a phase selector house (54), having an outgoing conductor (102), a contact (136), removable between different phase connections (98), and a phase selector indicator (156) which can be observed from outside.

11 Claims, 7 Drawing Sheets

CONNECTION DEVICE

The present invention relates to a connection device, particularly one cooperating with a current rail.

Connection devices of this kind are already known, see e.g. applicant's Swedish patent No. 8401925-6. Said known connection device is designed to be placed in a current rail having a substantially C-shaped cross section and being provided with flange-like portions turned towards a longitudinal hole and on the inner surfaces of which electric conductors are arranged. Said known connection device can be inserted in an arbitrary place in said longitudinal hole by means of a list-shaped insertion part and fastened there by means of an outwardly revolving contact and locking bar, provided with electrical contact pins. In order to additionally explain this already known technique such a known connection device is described in the following, with reference to FIG. 1.

It is true that said known connection device on the whole is advantageous and functions satisfactorily, but it is a primary object of the present invention to, as regards attachment and removal, develop said known connection device in such a way, that said measures can be performed quickly, simply and reliably, without using loose parts and with a limited consumption of material as well as without a complicated combination of a multitude of structural parts.

Another object of the invention is to provide a connection device, in which a change of phase indication is accomplished simultaneously with and in the same work operation as the phase selection. Additional objects of the invention is to provide a connection device having a simple and rugged construction and low production and assembly costs.

In order to attain these objects a connection device of the above-described kind is characterized mainly by the particular features described hereinafter.

Additional advantageous features and advantages of the present invention are set forth in the ensuing description, which relates to a non-limiting embodiment of a connection device according to the invention, reference being made to the enclosed partly schematical drawings, in which.

Figure 8:
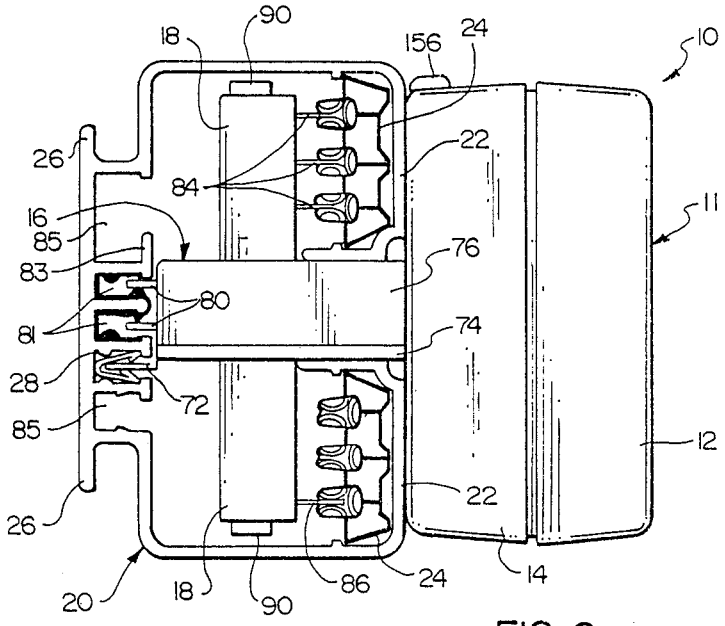
Figure 2:
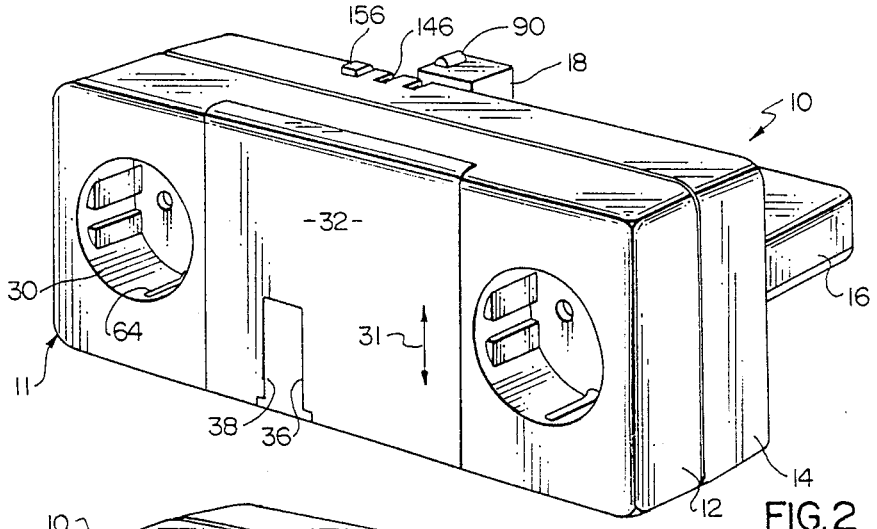
FIG. 2 is a perspective view from the front of a connection device according to the invention.
Figure 3A:
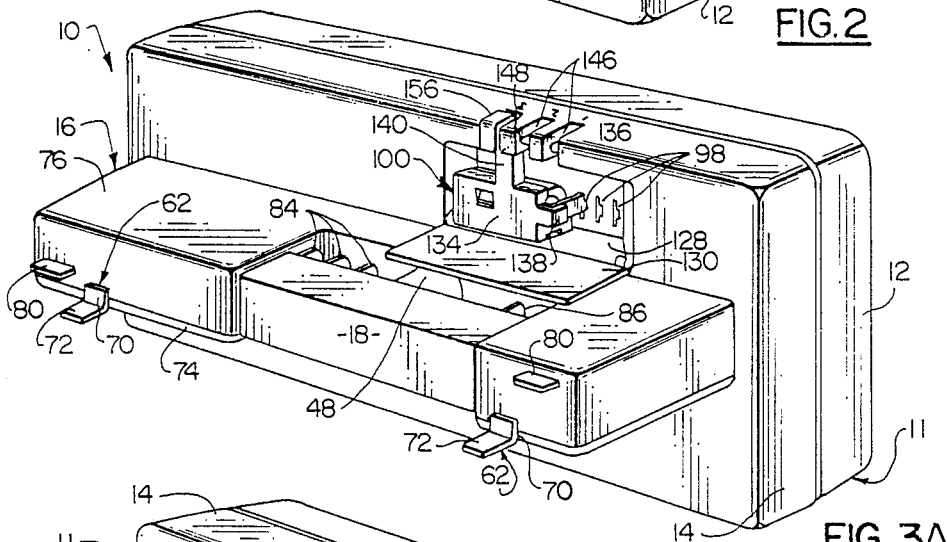
Figure 3B:
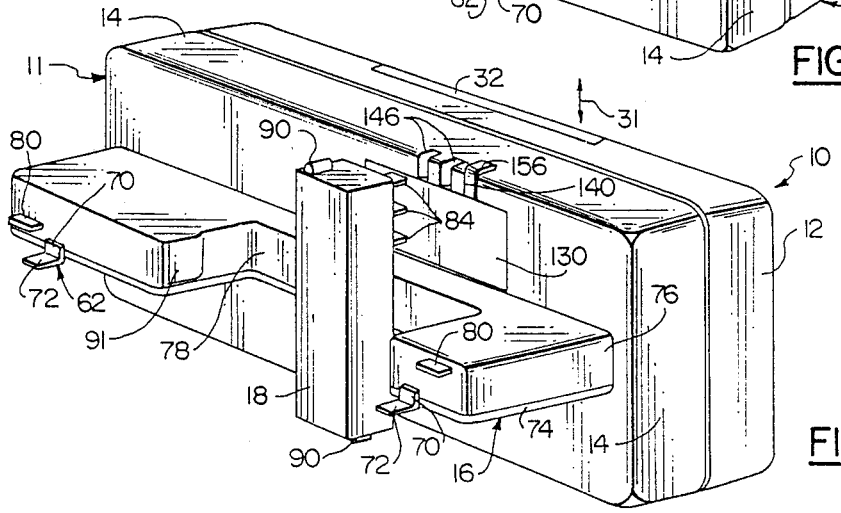
Figure 4:
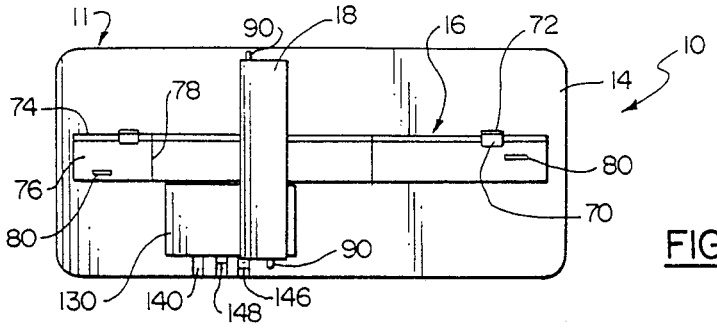
Figure 5:
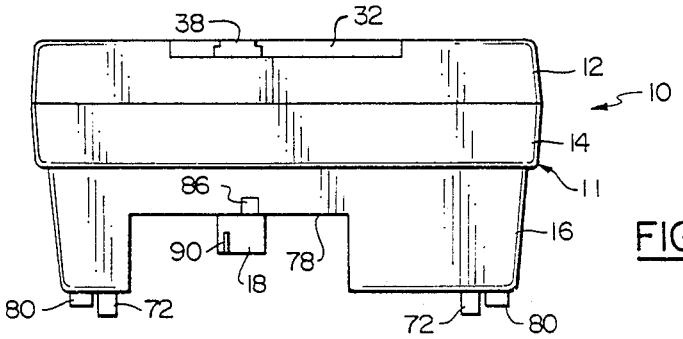
Figure 6:
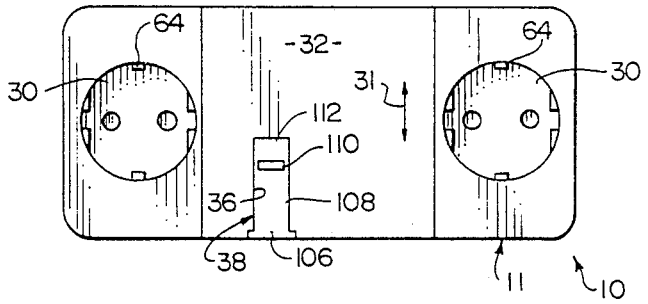
Figure 7:
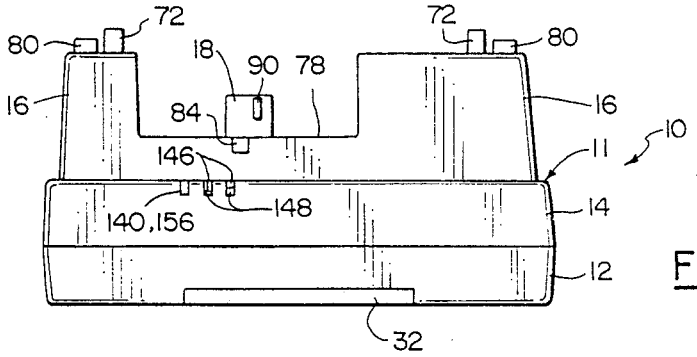
Figure 9:
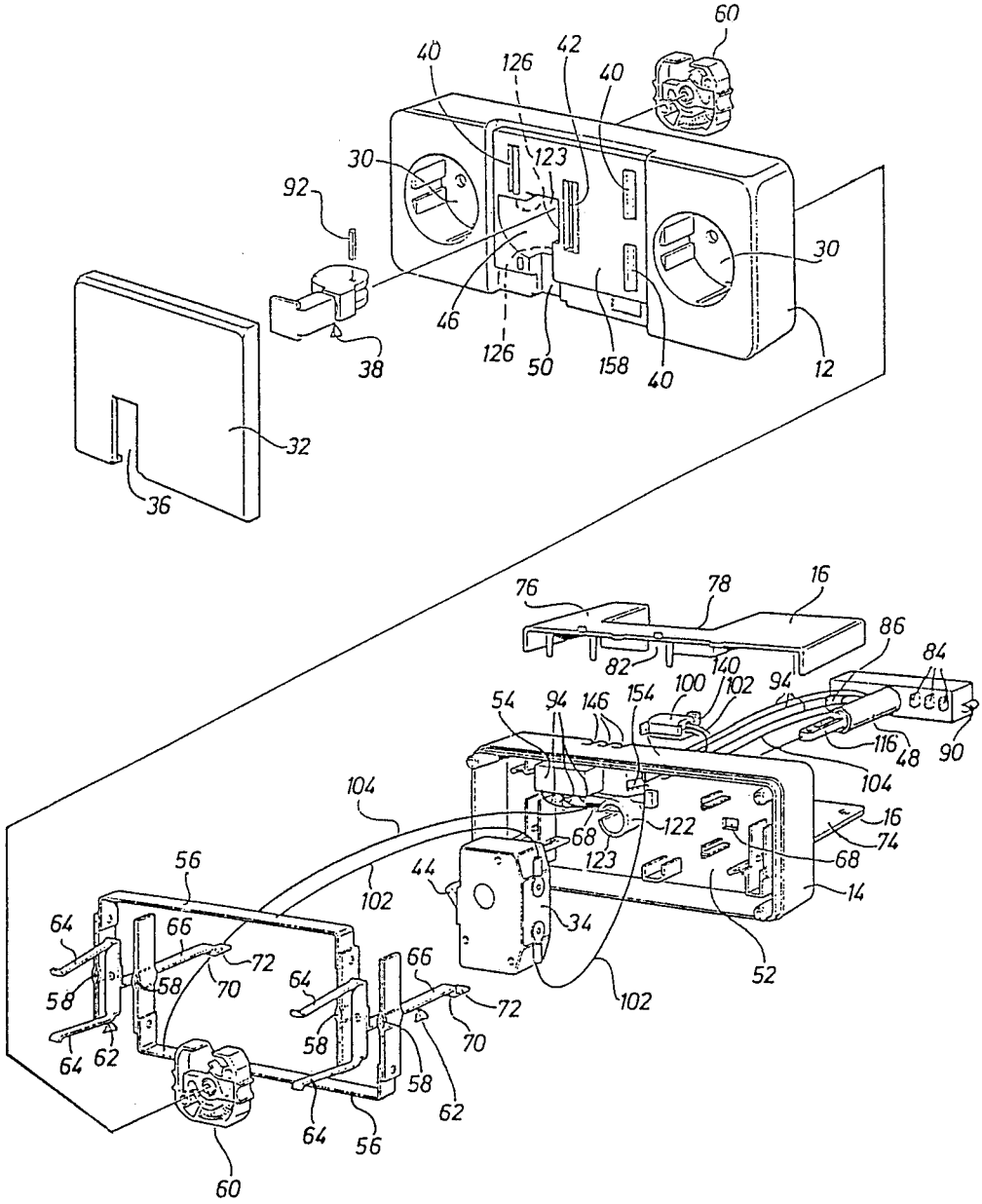
Figure 10:
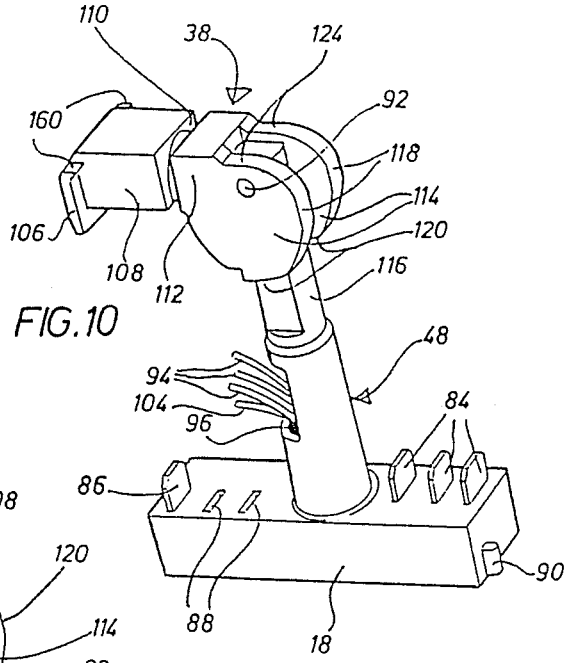
Figure 11:
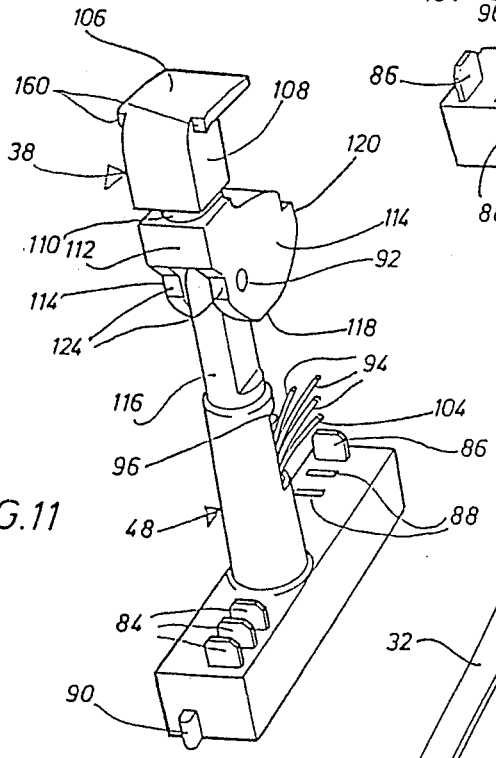
Figure 15:
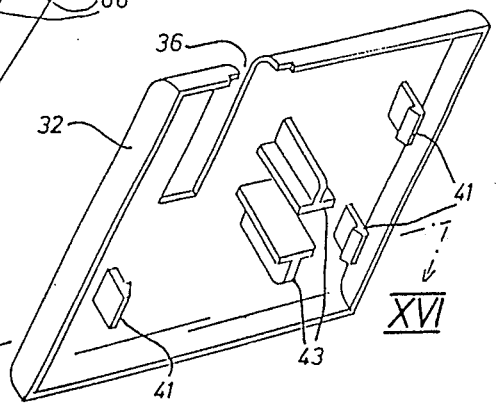
Figure 13:
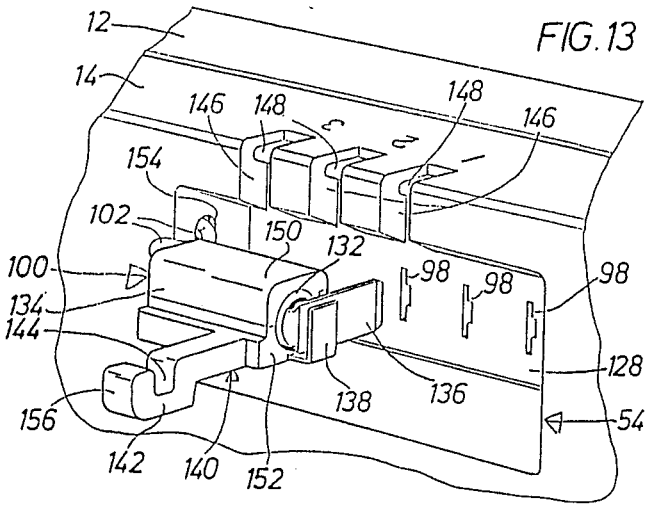
Figure 14:
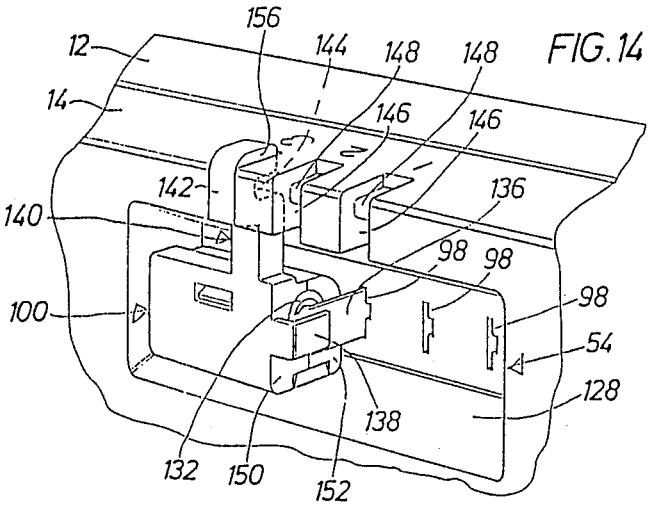
Figure 16:
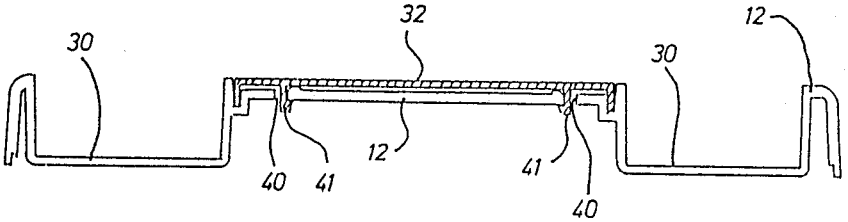

FIG. 3*a* is a perspective view from behind of the connection device according to the invention, showing its phase selector device;

FIG. 3*b* is a view, which corresponds to FIG. 3*a*, but the contact and locking bar is pulled out and pushed inwardly and the lid is closed over the phase selector device;

FIGS. 4–7 are various views of the connection device, viewed from behind, from below, from the front and from above;

FIG. 8 is an end view of the connection device inserted in a current rail;

FIG. 9 is an exploded view of the connection device according to the invention;

FIG. 10 is a detailed view of the contact and locking bar of the connection device having an appertaining eccentric arm in its lowered position;

FIG. 11 is a view, which corresponds to FIG. 10, with the eccentric arm it its elevated position;

FIGS. 12*a–d* are four different views, which show, how the eccentric arm cooperates with the sliding lid of the connection device;

FIG. 13 is a detailed view of the phase selector device in FIG. 3*a*, with the phase selector unit removed;

FIG. 14 is a view, which corresponds to FIG. 13, with its phase selector unit inserted; and FIGS. 15 and 16 are two views, which show the fastening of the sliding lid.

Figure 1:
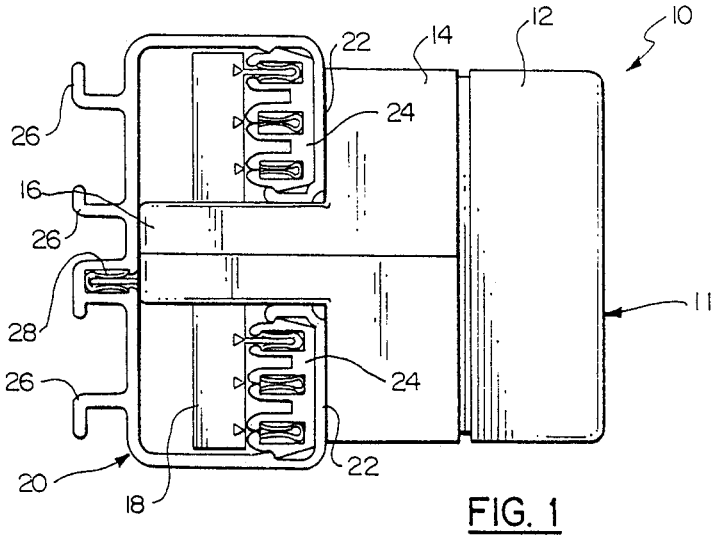
FIG. 1 is a view of an already known connection device, inserted in a current rail.

FIG. 1 shows a known connection device 10 comprising a shell 11 having a front piece 12 and a back piece 14 having an insertion part 16 as well as a contact and locking bar 18. The connection device is inserted into a C-shaped current rail 20 through a longitudinal hole on its divided face 22. On the rear or inner surface of the face profiles 24 of an insulating material are disposed having, embedded in the same, conductors in the form of double-folded sheet profiles. The rear surface of the current rail is provided with hook-shaped projections 26, used e.g. for wall mountings, and a ground conductor 28, which is recessed in a projecting groove.

The known contact and locking bar is provided with a phase contact pin, which is removable between various positions, and a neutral conductor contact pin. The contact and locking bar is operated by means of a removable tool, which is inserted through a hole in a sliding lid. The sliding lid cooperates with a switch, preferably a circuit breaker. The tool can be inserted only when the current is not turned on and consequently no power is withdrawn through the connection device.

The connection device according to the present invention will now be described primarily with reference to the exploded view in FIG. 9. What the connection device looks like in its assembled condition is shown in FIGS. 2–8. The connection device has roughly the same shape as the known connection device and the same reference numerals are used for its main parts. In front piece 12 of connection device 10 are provided two grounded terminal holes 30 and a sliding lid 32, which cooperates with a switch 34, preferably a circuit breaker. The sliding lid according to the invention is different from the known construction, since it has a groove 36, which extends in the direction of motion 31 of the lid. Groove 36 has been made for an operating arm 38, having an eccentric, for contact and locking bar 18.

Front piece 12 has three through grooves 40, designed for pins 41 provided with barbs and arranged on the inner surface of the sliding lid, by means of which pins the sliding lid can be fastened to the front piece in a way not to lose it. Also, the front piece has an operating groove 42 for two lid guiding pins 43 of the sliding lid, shown in FIG. 15. Said lid guiding pins project downwardly on either side of switching button 44 of switch 34 and cooperate with it, the result being that the sliding lid and the switching button are moving jointly. Also, the front piece has an operating hole 46 for operating arm 38, a through hole 47 for shaft 48 of the contact and locking bar as well as a recess 50, into which the operating arm can be lowered.

The back piece of the connection device has a cavity 52 with a phase selector house 54 and a few positioning projections, not described in detail here, for units disposed in cavity 52. Said units are switch 34, mentioned previously, two contact rails 56 having plug contact connections 58 disposed below terminal holes 30, two poke protective devices 60 and two ground contacts 62.

Ground contacts 62 comprise a ground contact part 64, disposed in the respective terminal hole 30, and a ground rail 66, which projects downwardly through holes 68 in the bottom of the cavity. The free ends of the ground rails are terminated by a transverse part 70 and a ground contact pin 72.

Insertion part 16 of back piece 14 comprises a plate 74 integral with the back piece and a cap part 76. In insertion part 16 there is a recess 78, designed to receive contact and locking bar 18 in a recessed position when inserting and removing the connection device respectively. The cap part has a through hole 82 in the bottom of recess 78 for shaft 48 of the contact and locking bar. On or in the walls of recess 78 stop means 91 for the rotary motion of the contact and locking bar are preferably arranged, in the form of projecting heads or non-through recesses in the wall. As an alternative, the contact and locking bar can have slanting short walls and the walls of the recess a corresponding slanting shape.

Ground contact rails 66 contact the end surface of plate 74 with their transverse parts 70 and are in this manner fastened in their insertion direction. It is shown clearly in FIGS. 3 and 8, that the end surfaces of the insertion part have longitudinal rails 80, designed to be inserted into the corresponding longitudinal groove 81 on a new improved current rail 20. In the latter the corresponding parts have the same reference numerals as in FIG. 1. The bottom of the current rail has a sunk, asymmetrically placed ground conductor 28 and at the same distance on the other side of the symmetry plane of the current rail a retaining rail 83, which is a safety device. When inserting connection device 10 up and down the path of ground contact pin 72 is blocked and consequently a wrong mounting is prevented.

Contact and locking bar 18 and its shaft 48 and operating arm 38 are clearly shown in FIGS. 10 and 11. Contact and locking bar 18 has three phase conductor contact pins 84, disposed in slots, on one of the bar arms. On the other bar arm a neutral conductor contact pin 86 is disposed, which in fact can be positioned in an arbitrary fashion in one of three slots. The remaining two slots 88 on said contact arm are kept in reserve and can e.g. be used when conductors for remote control and remote supervision are connected. Furthermore, said locking and contact bar has projection heads 90, which in their recessed position contact said stop means 91 in the insertion part and in their opened position can be used as a position setting spacer means in relation to the current rail. In the end of shaft 48 operating arm 38, which is provided with the eccentric, is fastened by means of an arbitrary shaft connection, e.g. a conical pin 92. How the operating arm functions will be explained in more detail in the following.

Every phase conductor contact pin 84 is connected to its phase conductor 94, which extends through shaft 48 and out of hole 96, which leads to cavity 52. The phase conductors extend there into phase selector house 54, in which each of them is connected to its insertion contact 98 for a phase selector device 100, which is removable between the insertion contacts. Its function is described in detail in the following. The phase selector device is, by means of a sole phase conductor 102, connected to switch 34. From there the phase conductor extends to one of contact rails 56.

Neutral ground contact pin 86 is connected to a neutral conductor 104, which extends through the hollow interior of shaft 48 and hole 96 up to the second one of contact rails 56.

Operating arm 38 comprises an end plate 106, an arm part 108 having a substantially rectangular cross-section, a waist part 110, a transition part 112 and two eccentric plates 114, which surround a shaft part 116 of shaft 48 provided with plane-parallel guide surfaces. Eccentric plates 114 are connected to shaft part 116 by means of said shaft 92. The eccentric plates have two different contact surfaces 118 and 120 respectively. Said contact surfaces are designed to abut a surface 123, e.g. a bottom of operating hole 46 or the end surface of a casing 122, which is a through hole for shaft 48 in back piece 14. In its contact position surface 120 in then placed at a larger distance, in the axial direction of shaft 48, from shaft 92 than surface 118.

Figure 12A:
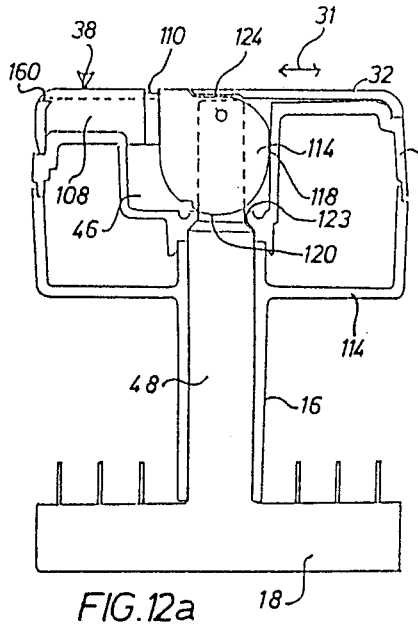

The function of the operating arm and its cooperation with sliding lid 32 is shown in FIGS. 12*a–d*. In FIG. 12*a* the operating arm is in its recessed position in groove 36 of sliding lid 32. Contact surfaces 120 of the eccentric plates, placed in the remotest position, contact bottom 123 of the operating hole and the contact and locking bar is retracted into its contact position against the current rail (not shown). Sliding lid 32 is inserted in the operating position of the switch. The sliding lid then covers lowered front surface 124 of transition part 112 and locking heads 160 of the end plate. In this position it is impossible to lift operating arm 38 from its recessed position. Also, it is then impossible to take the contact pin of the contact and locking bar out of its engagement with its respective conductors in the current rail.

Figure 12B:
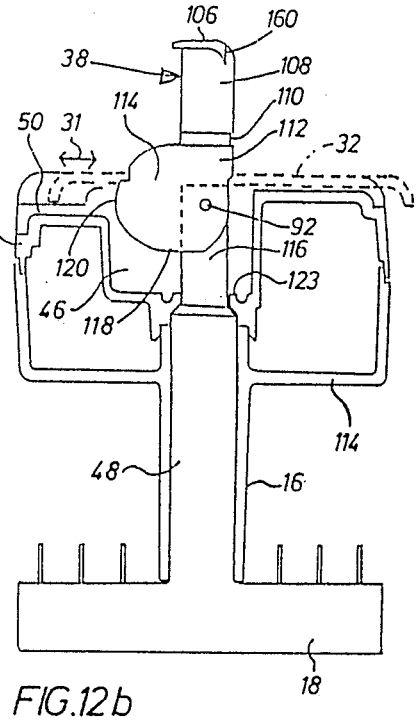
Figure 12C:
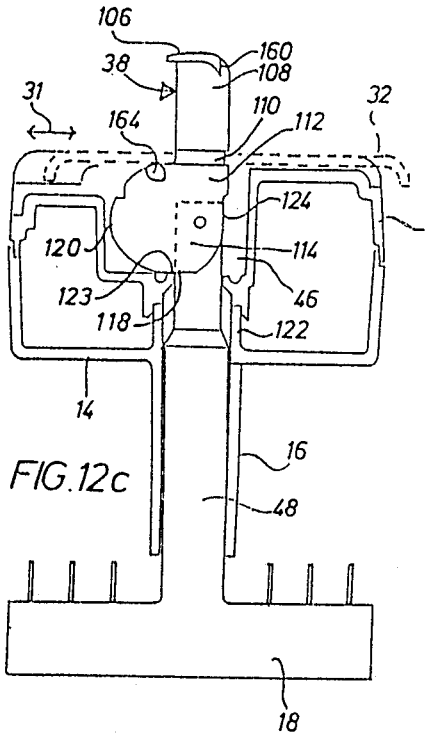

In FIG. 12*b* sliding lid 32 has been pulled aside and then the current has been disconnected because of the influence of the lid guiding pins on switching button 44 of switch 34 and subsequently the operating arm has been elevated. Contact surfaces 118 of the eccentric plates, placed close to the shaft, are placed at a distance from bottom 123 of the operating hole. The surfaces of eccentric plates 114 contact the surfaces of groove 36. In this way the rotation of operating arm 38 is prevented. The contact pin of the contact and locking bar is still engaging the respective conductors. In FIG. 12*c* the operating arm has been removed into its lower position by pushing end plate 106, until contact surface 118 close to shaft 92 has been brought into contact with bottom 123 of the operating hole. Waist part 110 is now on the same level as groove 36. Waist part 110, which is at least partly circular, does not prevent a rotation of operating arm 38. In this position the contact pin of contact and locking bar 18 has also been taken out of engagement with the conductors of the current rail, and consequently the contact and locking bar has been entirely removed from the current rail. Thus, in this position nothing prevents the rotation of operating arm 38 and consequently shaft 48 and contact and locking bar 18.

Figure 12D:
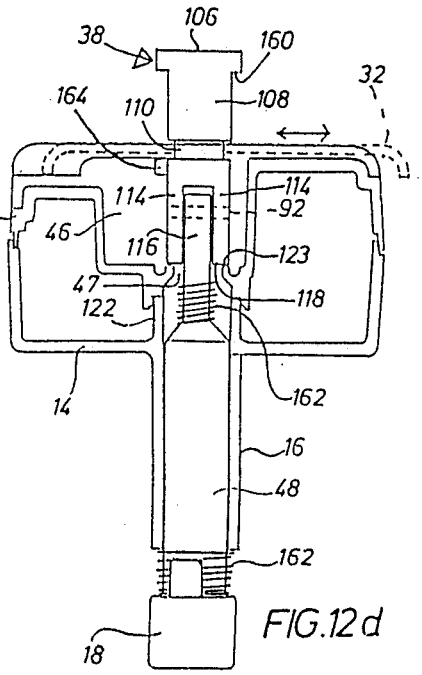

FIG. 12*d* shows the operating arm after a rotation of a quarter of a revolution. Contact and locking bar 18 is now recessed in insertion part 16 and it is possible to move the connection device out of or into a current rail 20.

In the shown embodiment of the invention operating hole 46 in the front piece is sector-shaped. Lateral surfaces 126 of the sector are then contact surfaces for eccentric plates 114 of the operating arm and thus limit the maximum rotational movement of the operating arm. Such a limitation of the maximum rotational movement can also be obtained, in case waist part 110 is only partly circular in shape and has plane contact surfaces against groove 36, which contact surfaces limit the rotational movement. This limitation of the rotational movement is particularly important in the opened position of the bar, since in that position it is impossible to arrange stop means on the current rail, which cooperate with the contact and locking bar. It must, as a fact, be possible to connect the connection device in an arbitrary place in the current rail. In its recessed position can, on the other hand, instead stop means for the contact and locking bar be disposed in connection with insertion part 116, as has been shown in the foregoing.

The system of the connection device for phase selection is mainly shown in FIGS. 3, 13 and 14. Phase selector house 54 includes a cavity 128, which is open towards the rear surface of the connection device and designed to receive phase selector device 100. The cavity is covered by a removable lid 130, which preferably can be opened up. The bottom of the cavity contains said three insertion contacts 98, which, as has been noted, are each connected via conductors 94 to its phase conductor contact pin 84.

Phase selector device 100 comprises a substantially cylindrical shaft body 132, which supports a handle and indicator part 134. The shaft body supports in its one end an angular contact pin 136, designed to be inserted into one of insertion contacts 98. From the other end of the shaft body conductor 102 issues, by means of which the phase selector is connected to switch 34. Handle and indicator part 134 has an end-positioned, hook-shaped projection 138, which surrounds angular contact pin 136 and fastens it in an axial direction in relation to the handle and indicator part. Handle and indicator part 134 also has an arm 140. This arm is terminated by a portion 142, which projects in a lateral direction and is hook-shaped and has a recess 144, transversely oriented in relation to the arm. The arm is designed to, with its hook-shaped portion, be recessed into one of three phase indicating recesses 146, recess 144 surrounding a position holding list 148, which is disposed in the respective phase indicating recess.

Handle and indicator part 134 is, in the shown example, designed with two halves 150,152 having half-cylindrical recesses for shaft body 132. Halves 150,152 can be joined in an arbitrary, known manner, e.g. by means of projections, shaped in the halves, and corresponding recesses. The handle and indicator part is, possibly excepting hook-shaped projection 138, made of an insulating material. At least arm 140 has in this case a color, which suitably is different from back piece 14 in order to facilitate a reading of the connected phase.

Conductor 102 issues from phase selector house 54 through a hole 154.

The function of the phase selector device is clearly shown in FIGS. 13 and 14, lid 130 being omitted for the sake of simplicity. In FIG. 13 phase conductor device 100 is shown in its removed position, arm 140 being elevated. Contact pin 136 can now be inserted in either one of insertion contacts 98. When this has been done, the arm is lowered, with its hook-shaped portion 142, into the corresponding phase, indicating recess 146. Recess 144 and position holding list (member) 148 then hold arm 140 and consequently all the phase selector device in relation to back piece 14 of the connection device. Electrically conducting contact pin 136 of the phase selector device can, in this way, not be removed from its position and damaged and can not damage phase selector house 54 due to exterior damage to that part 156 of the arm, which projects beyond the back piece.

The distance between contact pin 136 and arm 140 is determined by means of hook-shaped projection 138, and thus the distance between the same in the axial direction of the shaft body is the same as the distance between insertion contacts 98 and the respective corresponding phase indicating recess 146.

When the phase selector device is in its inserted position and the arm is recessed, all the handle and indicator part 134, excepting hook-shaped part 142, is placed below the plane of the back piece. Lid 130 can now be closed in order to have it positioned in the same plane as the back piece. However, other constructions are possible, e.g. to fasten the phase selector device in the lid displaceably in the axial direction.

When the phase selection is to be changed, the connection device must first be removed from the current rail, since the phase selector device is inaccessibly positioned on the rear surface of the connection device turned to the current rail. Subsequently lid 130 is opened and then arm 140 possibly is used as a lever to start the pulling up movement. Then the arm is pulled up into its position shown in FIG. 13 and can now be used as a handle to withdraw contact pin 136 and when the contact pin is inserted into another insertion contact 98. Subsequently the arm is recessed into the corresponding phase indicating recess 146 and the lid is closed.

In the embodiment of the invention shown in the figures sliding lid 32 is disposed in a recess 158 in front piece 12. It is of course feasible to dispose sliding lid 32 in a position on top of said front piece without any recess except for operating arm 38. The steering and the fastening of the sliding lid in the front piece can of course also be accomplished in another way, e.g. various guide lists or grooves and projecting lists at the lateral edges of the sliding lid. Furthermore, switching button 44 of switch 34 can influence the sliding lid in another way than by means of lid guiding pins. This is possible e.g. by inserting the switching button into a recess in the sliding lid or having it influence a displaceable movement transition device, which in its turn transfers the movement to the sliding lid.

End plate 106 of operating arm 38 preferably is broader than its substantially rectangular arm part 108 and has contact surfaces 160. Said contact surfaces are covered by sliding lid 32, when the lid has been slid into its covering position and the current has been turned on. Said contact surfaces efficiently prevent any attempt to turn up the operating arm, when the sliding lid is in its covering position.

The connection device preferably can include returning means, which, when operating arm 38 is pulled up, mechanically moves the contact and locking bar in an axial direction, which results in pulling its phase conductor pin 84 and neutral conductor pin 86 out of engagement with the conductors of the current rail. Examples of such returning means is a pull back spring 162 (FIG. 12*d*) disposed around shaft 48 between contact and locking bar 18 and back piece 14 and insertion part 16 respectively. Such a spring can, as an alternative, be disposed at least partly inside casing 122. Other possible returning means are various lever arrangements or eccentric arrangements, which have an effect on a contact surface opposite contact surface 123. Examples of such lever arrangements is a sliding knob 164, only shown in FIGS. 12*c* and *d*. It projects from the one eccentric plate 114 and abuts the inner surface of the sliding lid. For assembly reasons it must be possible during assembly to insert sliding lid 32 laterally in guide grooves in front piece 12. Subsequently to the mounting of the sliding lid it is suitable to limit its movements by means of a resilient, locking movement restriction device or subsequently mounted stop means.

Instead of a sliding lid 32 having a groove 36 for operating arm 38 the connection device according to the invention can include holding elements designed in another way, which cooperate with switch 34 and in a locking way cover contact surfaces 124 and 160 respectively on the operating arm in the switching on position of the switch.

Improved current rail 20, shown in FIG. 8, can on each side of grooves 81 include communication conductors for weak current transmitted signals. In order to be connected to these communication conductors a connection device 10, adapted to them, is provided with contact means, not shown, e.g. of sheet metal, placed on top of the device or partly embedded contact wires, which are disposed on the long sides of at least one of lists 80. In order to supply a current to an apparatus, connected to the weak current device, a current is drawn from the conductors of the current rail in the way described in the foregoing. To achieve this, the transformers for voltage reduction and/or rectifiers can be disposed in the interior of the device. Also, printed circuits can be disposed in the interior of a weak current type connection device, preferably in insertion part 16. Of course, in this instance the connection device is provided with an outlet for the communication apparatus or the instrument, which is to be connected to the communication conductors in grooves 81.

Also, new current rail 20 is, on its rear surface, provided with longitudinal boxes 85. In these boxes e.g. conductors, independent of connection device 10, such as a coaxial cable or a data bus, can be placed. The placing of these independent conductors through the longitudinal hole in the current rail, in order to provide outlets or a connection to an apparatus, can be performed in specific areas, while the current rail for the rest without any obstacle is accessible to connection device 10.

We claim:

1. A connection device (10), designed to cooperate with a current rail (20), including a shell (11) having a body (12, 14) with at least one outlet hole (30) provided therein, an insertion part (16) connected with said body and being engagable with a said current rail (20), and a contact and locking bar (18), having slits for phase conductor contact pins (84) and a neutral conductor contact pin (86), being pivotably and reciprocatively connected to said device adjacent the insertion part, the contact pins and the neutral conductor of the contact and locking bar being engagable with phase and neutral conductors, respectively, of a said current rail, wherein an operating arm (38), provided with an eccentric, is pivotally attached to a shaft (48) connected with said contact and locking bar for achieving said pivotal and reciprocative connection of the contact and locking bar (18) to said device, a pivotal movement of said operating arm (38) relative to said shaft causes the eccentric (114) to abut against the shell (surface 123) thereby forcing the shaft to move in one direction to cause engagement of the contact and locking bar (18) with the conductors of a said current rail when engagable therewith and the shaft being movable in an opposite direction to cause disengagement of the contact and locking bar (18) from the conductors of the current rail when engaged therewith.

2. A connection device according to claim 1, wherein the operating arm (38), provided with the eccentric, can be pivoted into a pulled down position in a hole 46 of the body so that the phase contact pins (84) and neutral conductor pin (86) of the contact and locking bar (18) engage the conductors of a said current rail.

3. A connection device according to claim 2, wherein a switch (34) is disposed in the connection device and the operating arm and the eccentric have contact surfaces (124, 160) which, when in said pulled down position, are locked and covered by a fastening element (32), and the fastening element cooperates said switch which is in an on position when said operating arm (38) and the eccentric are locked and covered by said fastening element (32).

4. A connection device according to claim 3, wherein said fastening element is a sliding lid (32) having a groove (36) extending in a direction of sliding movement of the sliding lid for engaging the operating arm (38) when in a pulled up position.

5. A connection device according to claim 4, wherein the operating arm (38) has eccentric plates (114) with parallel lateral surfaces and a waist part (110) having a small cross-sectional surface area, said parallel lateral surfaces, when the operating arm (38) is in the pulled up position and when the contact and locking bar (18) is still engaged with a said current rail (20), abuts against lateral walls of said groove (36, 50) to prevent rotation of said operating arm, and when said operating arm (38) is in its pulled up position and forced toward said hole, the contact and locking bar (18) is disengaged from a said current rail (20) and the waist part is located adjacent the lateral walls of said groove (36, 50) in the sliding lid (32) so that the lateral walls of the groove (36, 50) are received by said waist part (110) and said operating arm (38) and the contact and locking bar (18) are freely rotatable.

6. A connection device according to claim 1 wherein said device is provided with means for limiting rotation of the operating arm (38) and the contact and locking bar (18) so that engagement and disengagement of the contact and locking bar (18) with a said current rail (20) is facilitated.

7. A connection device according to claim 3, wherein a said current rail has three phases and a phase selector device (100) brings about an electrical connection between only one of the three phases of a said current rail (20) and said switch (34), a phase selector house (54), disposed in the body (12, 14) of the connection device, has three insertion contacts (98), one for each phase, and the phase selector device (100) has a contact pin (136) connected to one of the insertion contacts and an outgoing conductor (102) connected to said switch of the connection device.

8. A connection device according to claim 7, wherein the phase selector device (100) includes a pivotable phase selector arm (140), which can be inserted into one of three phase indicating recesses (146), has a projecting part (156) that can be observed from outside, each phase indicating recess has a position-fixing member (148), and the phase selector arm has a recess (144) for engaging a respective position-fixing member (148).

9. A connection device according to claim 7, wherein each one of the insertion contacts (98) is connected via a conductor (94) to a phase conductor contact pin (84)

of the contact and locking bar whereby a uniform phase indication is accomplished.

10. A connection device according to claim 8, wherein the phase selector arm (140) of the phase selector device (100) is positioned a certain axial distance from its contact pin (136), the axial distance corresponding to an axial distance between the respective phase connected insertion contact (98) and the corresponding phase indicating recess, and the phase selector device includes a shaft body (132) having an angular contact pin and a hook-shaped recess (138) which surrounds the contact pin (136).

11. A connection device according to claim 1, wherein mechanical means are provided for displacement of the shaft in the opposite direction.

* * * * *